US007935469B2

(12) United States Patent
Honda et al.

(10) Patent No.: US 7,935,469 B2
(45) Date of Patent: May 3, 2011

(54) IMAGE FORMING METHOD AND TONER FOR DEVELOPING LATENT ELECTROSTATIC IMAGE

(75) Inventors: Takahiro Honda, Fujinomiya (JP); Hiroyuki Fushimi, Numazu (JP); Fumihiro Sasaki, Fuji (JP); Hisashi Nakajima, Numazu (JP); Yasuo Asahina, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 539 days.

(21) Appl. No.: 12/048,823

(22) Filed: Mar. 14, 2008

(65) Prior Publication Data

US 2008/0227003 A1 Sep. 18, 2008

(30) Foreign Application Priority Data

Mar. 16, 2007 (JP) ..... 2007-069389
Feb. 26, 2008 (JP) ..... 2008-044148

(51) Int. Cl.
*G03G 9/087* (2006.01)
*G03G 13/20* (2006.01)

(52) U.S. Cl. ..... 430/109.2; 430/109.1; 430/124.1

(58) Field of Classification Search ..... 430/109.1, 430/109.2, 124.1
See application file for complete search history.

(56) References Cited

U.S. PATENT DOCUMENTS 5,780,195 A * 7/1998 Nava ..... 430/109.2
7,179,577 B2 2/2007 Matsuda et al.
7,261,989 B2 8/2007 Sugiura et al.
7,300,736 B2 11/2007 Fushimi et al.
7,318,989 B2 1/2008 Kotsugai et al.
7,323,281 B2 1/2008 Emoto et al.
2005/0026064 A1 2/2005 Sugiura et al.
2005/0089786 A1 4/2005 Sugiura et al.
2005/0089787 A1 4/2005 Uchinokura et al.
2005/0112488 A1 5/2005 Yamada et al.
2005/0208408 A1 9/2005 Uchinokura et al.
2006/0029433 A1 2/2006 Saito et al.
2006/0063081 A1 3/2006 Nagatomo et al.
2006/0154168 A1 7/2006 Tomita et al.
2006/0204883 A1 9/2006 Nakayama et al.
2007/0059063 A1 3/2007 Nakayama et al.
2007/0190444 A1 8/2007 Kotsugai et al.
2007/0218389 A1 9/2007 Honda et al.

FOREIGN PATENT DOCUMENTS

JP 61-7844 1/1986
JP 2001-209209 8/2001
JP 3392038 1/2003
JP 2006-72093 3/2006
JP 3878468 11/2006

OTHER PUBLICATIONS

U.S. Appl. No. 12/047,807, filed Mar. 13, 2008, Honda, et al.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

Disclosed is a developer containing toner and carrier, the toner containing as a binder resin a polyol resin having a plurality of OH groups in a molecule chain having an EX/OH ratio between epoxy groups (EX) and OH groups (OH) of 0.990 to 1.010. The rotational speed $\alpha$, pitch $\beta$ and conveyance path length $\gamma$ of an stirring and conveying unit satisfies $1.0\times10^6 \leqq \alpha\times\beta\times\gamma \leqq 16.0\times10^6$. Toner base particles having an electrostatic property satisfies $1.5<[Q^B/M_{3600}]/[Q^B/M_{180}]<2.5$, toner having an electrostatic property satisfies $0.7<[Q^T/M_{3600}]/[Q^T/M_{180}]<1.3$, the external additive comprises two types of fine inorganic particles having different resistance values, wherein the particle size distribution Y and added amount X of the fine inorganic particles with smaller resistance satisfy $0.1 \leqq x \leqq 2.0$, and $Y \leqq 2.6\times10^{-3}X+0.0048$.

10 Claims, No Drawings

IMAGE FORMING METHOD AND TONER FOR DEVELOPING LATENT ELECTROSTATIC IMAGE

BACKGROUND OF THE INVENTION

1. Field of the Invention

The present invention relates to an image forming method for developing a latent electrostatic image and a toner for developing a latent electrostatic image with electrophotography. More specifically, the present invention relates to an image forming method and a toner for developing a latent electrostatic image which enables high-speed two-component development.

2. Description of the Related Art

Conventionally, in image forming apparatus using electrophotography, such as printers or copying machines, from the viewpoint of image quality, durability and high-speed responsiveness, it is desirable to use a two-component developer containing a toner and a carrier. In a two-component development system of this kind, in order to ensure sufficient image density and to improve the reproducibility of fine lines, a developing method is used in which a magnetic brush of developer is placed in contact with a photoconductor, and the circumferential speed of the development sleeve is made faster than the circumferential speed of the photoconductor.

On the other hand, advances have recently been made in respect of achieving full color images, systematization and digitalization in the field of electrophotography, and there have also been demands for higher quality in the output image, faster output speed, and greater stability. The expansion of copying machines and various types of printers into the on-demand printing market is expected. In order to break into the printing market using the electrophotographic method generally employed in copying machines and printers, it is necessary to achieve high quality and high stability, even in the case of long-term, high-speed processing output. An image forming apparatus of this kind, in which a photoconductor and a development sleeve are rotated at high speed and the output of images suitable for the printing market is continued over a long period of time, differs greatly from an image forming apparatus having a medium speed of rotation, which has a normal stirring history and stirring frequency of the developer agent inside the developing unit, and more specifically, a normal continuous contact frequency between the toner and the carrier. Furthermore, these differences become even more pronounced as the conveyance path of the developer becomes longer, due to increase in the size of the development apparatus as a result of increase in the printing speed.

In an ultra-high-speed image forming apparatus which has extremely high continuous contact frequency between the toner and the carrier in this way, charging up of the developer occurs due to the high continuous contact frequency, leading to problems of decline in the image density, and therefore the object of achieving good image stability cannot be attained.

In order to suppress this charging up phenomenon, Japanese Patent Application Laid-Open (JP-A) Nos. 11-231567 and 2001-209209 use a toner formed by adding two types of silica having different degrees of hydrophobization, externally, to the surface of toner. However, in the toners proposed in these references, the difference in the degree of hydrophobization between the two types of silica which are added externally to the toner particles is small and therefore it is not possible to suppress charging up in a high-speed image forming apparatus. Furthermore, in JP-A No. 2006-072093, two different types of silica which are balanced in terms of the difference in the degree of hydrophobization and the difference in particle size are added externally to the surface of toner, but this is not sufficient to suppress the charging up which occurs in an ultra-high-speed image forming apparatus.

On the other hand, with regard to the binder resin used in the toner, in order to achieve high image luster in a full color image, as well as good color reproduction, and a broad fixing temperature range, JP-A No. 61-007844 uses a polyester resin as the binder resin, and JP-A No. 2003-173045 uses a polyol resin. However, if the prior option, the polyester resin, is used, then in an ultra-high-speed image forming apparatus, aggregated material is liable to occur inside the toner bottle or the developing unit, in particular, and a phenomenon of image loss (blank areas) occurs in the portions where the aggregated material is present. Furthermore, if the acid number of the polyester resin is high, then since ambient changes are liable to occur in a low-temperature and low-humidity environment, the charging up phenomenon is encouraged and image density declines. If the latter option, namely, the polyol resin, is used, then although the generation of aggregated material is suppressed, there is some moisture absorption in high-temperature and high-humidity environments, due to the effects of the OH groups in the polymer chain, and consequently a charging down phenomenon occurs and problems of toner scattering and background smear, and the like, arise. Therefore, it is not possible to achieve the object of improving image quality.

BRIEF SUMMARY OF THE INVENTION

An object of the present invention is to provide an image forming method and a toner for developing a latent electrostatic image, using an ultra-high-speed image forming apparatus, whereby the issues of charging up in the case of long-term continuous output, and charging down in a high-temperature, high-humidity environment, can be resolved simultaneously.

The characteristic features of the present invention for achieving the aforementioned object are as follows.

<1> An image forming method including: charging; exposing; developing; transferring; and fixing, wherein a developer used in the developing is a two-component developer that comprises a toner and a carrier, the toner containing as a binder resin a polyol resin having a plurality of OH groups in a molecule chain having an EX/OH ratio between epoxy groups (EX) and OH groups (OH) of 0.990 to 1.010, the developing step comprises stirring and conveying for conveying at least the developer while stirring and charging the developer, in the stirring and conveying step a rotational speed $\alpha$ (revolutions per minute), a pitch $\beta$ (mm) and a conveyance path length $\gamma$ (mm) of an stirring and conveying unit, excluding a developing unit, satisfies the relationship $1.0\times10^6 \leqq \alpha\times\beta\times\gamma \leqq 16.0\times10^6$, the toner is composed of toner base particles and an external additive, the toner base particles having an electrostatic property by stirring with the carrier is such that a ratio between charge amount after continuous stirring for 3 minutes, $Q^B/M_{180}$ (−μC/g), and charge amount after continuous stirring for 60 minutes, $Q^B/M_{3600}$ (−μC/g) satisfy the following Formula (I):

$$1.5<[Q^B/M_{3600}]/[Q^B/M_{180}]<2.5 \qquad \text{Formula I}$$

the toner having an electrostatic property by stirring with the carrier is such that a ratio between charge amount after continuous stirring for 3 minutes, $Q^T/M_{180}$ (−μC/g), and charge amount after continuous stirring for 60 minutes, $Q^T/M_{3600}$ (−μC/g) satisfy the following Formula (II):

$$0.7<[Q^T/M_{3600}]/[Q^T/M_{180}]<1.3 \quad \text{Formula II}$$

and the external additive comprises two types of fine inorganic particles having different resistance values, wherein a particle size distribution Y and added amount X, in terms of parts by mass with respect to 100 parts by mass of the toner base particles, of the fine inorganic particles having a smaller resistance value than the other fine inorganic particles satisfy the following Formula (III):

$$0.1 \leqq x \leqq 2.0$$

$$Y \leqq 2.6\times10^{-3}X+0.0048 \quad \text{(Formula III).}$$

<2> The image forming method according to <1>, wherein an adherence rate, expressed by the following Formula IV, of the fine inorganic particles of the external additive having a smaller resistance value is 65% to 95%:

$$(M_1/M_0)\times100\ (\%) \quad \text{(Formula IV)}$$

where $M_1$ is the weight of fine inorganic particles adhering to surfaces of the toner base particles after the toner including the external additive has been dispersed in an aqueous solution containing a surfactant and subjected to ultrasonic treatment for 1 minute at a resonance frequency 25 kHz; and $M_0$ is the weight of fine inorganic particles adhering to surfaces of the toner base particles before carrying out the ultrasonic treatment.

<3> The image forming method according to one of <1> and <2>, wherein the toner base particles have an average circularity of 0.910 to 0.970.

<4> The image forming method according to any one of <1> to <3>, wherein the fine inorganic particles that adhere to surfaces of the toner base particles have a degree of hydrophobization of 55% to 95% as measured with methanol method.

<5> The image forming apparatus according to any one of <1> to <3>, wherein the fine inorganic particles of the external additive having a smaller resistance value are made of titanium oxide which has been subjected to hydrophobization treatment.

<6> A toner for developing latent electrostatic images that is used in a two-component developer that comprises a toner and a carrier, the toner containing as a binder resin a polyol resin having a plurality of OH groups in a molecule chain having an EX/OH ratio between epoxy groups (EX) and OH groups (OH) of 0.990 to 1.010, wherein the toner is composed of toner base particles and an external additive, the toner base particles having an electrostatic property by stirring with the carrier is such that a ratio between charge amount after continuous stirring for 3 minutes, $Q^B/M_{180}$ (−μC/g), and charge amount after continuous stirring for 60 minutes, $Q^B/M_{3600}$ (−μC/g) satisfy the following Formula (I):

$$1.5<[Q^B/M_{3600}]/[Q^B/M_{180}]<2.5 \quad \text{Formula I}$$

the toner having an electrostatic property by stirring with the carrier is such that a ratio between charge amount after continuous stirring for 3 minutes, $Q^T/M_{180}$ (−μC/g), and charge amount after continuous stirring for 60 minutes, $Q^T/M_{3600}$ (−μC/g) satisfy the following Formula (II):

$$0.7<[Q^T/M_{3600}]/[Q^T/M_{180}]<1.3 \quad \text{Formula II}$$

and the external additive comprises two types of fine inorganic particles having different resistance values, wherein a particle size distribution Y and added amount X, in terms of parts by mass with respect to 100 parts by mass of the toner base particles, of the fine inorganic particles having a smaller resistance value than the other fine inorganic particles satisfy the following Formula (III):

$$0.1 \leqq x \leqq 2.0$$

$$Y \leqq 2.6\times10^{-3}X+0.0048 \quad \text{(Formula III).}$$

<7> The toner for developing latent electrostatic images according to <6>, wherein an adherence rate, expressed by the following Formula IV, of the fine inorganic particles of the external additive having a smaller resistance value is 65% to 95%:

$$(M_1/M_0)\times100\ (\%) \quad \text{(Formula IV)}$$

where $M_1$ is the weight of fine inorganic particles adhering to surfaces of the toner base particles after the toner including the external additive has been dispersed in an aqueous solution containing a surfactant and subjected to ultrasonic treatment for 1 minute at a resonance frequency 25 kHz; and $M_0$ is the weight of fine inorganic particles adhering to surfaces of the toner base particles before carrying out the ultrasonic treatment.

<8> The toner for developing latent electrostatic images according to one of <6> and <7>, wherein the toner base particles have an average circularity of 0.910 to 0.970.

<9> The toner for developing latent electrostatic images according to any one of <6> to <8>, wherein the fine inorganic particles that adhere to surfaces of the toner base particles have a degree of hydrophobization of 55% to 95% as measured with methanol method.

<10> The toner for developing latent electrostatic images according to any one of <6> to <8>, wherein the fine inorganic particles of the external additive having a smaller resistance value are made of titanium oxide which has been subjected to hydrophobization treatment.

According to the present invention, it is possible to provide an image forming method and a toner for developing latent electrostatic image used in an ultra-high-speed image forming apparatus, whereby charging up during long-term continuous output and charging down in a high-temperature, high-humidity environment can be resolved simultaneously.

DETAILED DESCRIPTION OF THE INVENTION

The present invention is described in more detail below.

The present inventors discovered that, from one perspective, by using two types of fine inorganic particles having different resistance values in a toner having fine inorganic particles added to the surface of toner base particles, and by adjusting the balance between the particle size distribution and the added amount of the fine inorganic particles having a lower resistance value, then it is possible to provide stable images over a long period of time, even when used under manufacturing process conditions where the continuous contact frequency between the toner and the carrier in the developing unit is very much higher than in a medium or low-speed image forming apparatus, as in the case of a two-component developer in an ultra-high-speed image forming apparatus. They also discovered that stable images can be provided over an even longer period of time by strengthening the adherence of the fine inorganic particles having lower resistance to the surface of the toner base particles.

The fine inorganic particles having the higher resistance value, of the fine inorganic particles of two types which are attached to the surface of the toner base particles, increase the charge amount on the toner by rubbing against the carrier, or the like, while the fine inorganic particles having the lower resistance value leak out the toner charge by rubbing against the carrier, or the like. In a developer for an ultra-high-speed image forming apparatus in which the continuous contact frequency between the toner and carrier is very much higher than in a medium or low-speed image forming apparatus, charging up occurs frequently, and therefore it is necessary for the charge accumulated by this charging up phenomenon to be leaked out. The present inventors discovered that the aforementioned problems are resolved by adjusting the balance of the particle size distribution and the added amount of the fine inorganic particles of lower resistance, which form the charge leaking component.

In other words, if the particle size distribution of the fine inorganic particles having lower resistance is taken to be Y and the added amount of same is taken to be X (where X is the number of parts with respect to 100 parts by mass of toner base particles), then the fine inorganic particles are added externally to the surface of the toner base particles in such a manner that the relationships:

$$0.1 \leqq x \leqq 2.0$$

$$Y \leqq 2.6\times10^{-3}X+0.0048$$

are satisfied, and preferably, in such a manner that $0.5 \leqq x \leqq 1.5$. If the added amount X is less than 0.1, then however small the particle size and however sharp the particle size distribution of the fine inorganic particles which are made to adhere to the toner base particles, the fine inorganic particles are not sufficient to leak out an amount of charge equivalent to that accumulated by charging up. Furthermore, if the added amount X is less than 0.1, then the fluidity of the toner cannot be ensured, replenishment of toner cannot keep up with demand in the case of continuous output of images of high surface area, and therefore abnormal images occur. On the other hand, if the added amount X is greater than 2.0, then with long-term use, the fine inorganic particles fuse (become spent) on the surface of the carrier, the charging capacity of the carrier declines, and sufficient toner charging cannot be achieved, leading to image abnormalities such as background smear, scattering of toner, and the like.

Furthermore, in the range $Y>2.6\times10^{-3}X+0.0048$, however sharp the particle size distribution of the fine inorganic particles used, it is not possible to leak out adequately the charge accumulated by charging up, since the absolute amount of fine inorganic particles on the surface of the toner base particles is insufficient.

Preferably, of the external additive which adheres to the surface of the toner base particles used in the present invention, the rate of adherence to the surface of the toner base particles of the fine inorganic particles forming one external additive having lower resistance, is 65% to 95%, and more preferably, this adherence rate is 80% to 95%. If this adherence rate is less than 65%, then with use over a long period of time, the fine inorganic particles become detached from the surface of the toner base particles, the charge leaking points decrease in number, and therefore charging up is not suppressed. On the other hand, in practical terms, a value greater than 95% means that the fine inorganic particles bury the surface of the toner base particles, albeit not completely, and hence there is an insufficiency of leak points, and charging up cannot be suppressed. Furthermore, it is not possible to ensure the fluidity of the toner, either.

The adherence rate is expressed by (Formula IV) below.

$$(M_1/M_0)\times100\ (\%) \qquad \text{(Formula IV)}$$

In this formula, $M_1$ is the weight of fine inorganic particles which adhere to the surface of the toner base particles after the toner containing the aforementioned external additive has been dispersed in an aqueous solution of surfactant and has been subject to the ultrasonic treatment for 1 minute at a resonance frequency of 25 kHz, and $M_0$ is the weight of fine inorganic particles which adhere to the surface of the toner base particles before carrying out ultrasonic treatment.

Furthermore, the degree of hydrophobization (based on a methanol measurement method) of the fine inorganic particles forming the external additive adhering to the surface of the toner base particles used in the present invention is preferably 55% to 95%. If the degree of hydrophobization (methanol method) is less than 55%, then the toner base particles become susceptible to the effects of moisture in a high-temperature and high-humidity environment, charging down occurs and image abnormalities, such as background smear, toner scattering, or the like, occur. On the other hand, if the degree of hydrophobization is greater than 95%, then the hydrophobic properties becomes so high that charging up occurs in low-temperature low-humidity conditions, and hence the fine inorganic particles cannot perform their function as a leaking component.

The average circularity of the toner base particles used in the present invention is preferably 0.910 to 0.970. More preferably, it is 0.920 to 0.960. If the average circularity is less than 0.910, then the probability of contact between the external additive and the carrier, or the like, becomes low, and although this is suitable for ensuring leak points, the limitation on the number of contact points gives rise to a shortage in the overall amount of charge. Moreover, transfer properties are poor and decline in image quality arises due to transfer failures. On the other hand, if the average circularity is greater than 0.970, then although the transfer properties are good, the probability of contact between the external additive and the carrier, or the like, becomes greater and therefore, with long-term use, separation or burial of the external additive occurs, charging up is not suppressed, and furthermore, various problems occur, such as decline in fluidity.

The toner base particles used in the present invention have charging properties resulting from stirring with the carrier such that the ratio between the charge amount $Q^B/M_{180}$ (−μC/g) after continuous stirring for 3 minutes and the charge amount $Q^B/M_{3600}$ (−μC/g) after continuous stirring for 60 minutes satisfies $1.5<[Q^B/M_{3600}]/[Q^B/M_{180}]<2.5$. Here, $[Q^B/M_{3600}]/[Q^B/M_{180}]$ means the ratio between $Q^B/M_{180}$ and $Q^B/M_{3600}$ (the same applies below). When only toner base particles which do not include external additive are stirred with carrier, then normally the charge increases as the stirring time increases, but if $[Q^B/M_{3600}]/[Q^B/M_{180}]$ is less than 1.5, then supposing that the fine inorganic particles according to the present invention are added, the charge will decline excessively with long-term use, and image abnormalities such as background smear, scattering of toner, or the like, will arise. On the other hand, if the aforementioned ratio is greater than 2.5, then even if the fine inorganic particles according to the present invention are added, the charging up of the toner cannot be absorbed sufficiently, and image abnormalities, such as decline in image density, arise.

Furthermore, the toner including external additive used in the present invention has charging properties resulting from stirring with the carrier whereby the ratio between the charge amount $Q^T/M_{180}$ (−μC/g) after continuous stirring for 3 minutes and the charge amount $Q^T/M_{3600}$ (−μC/g) after continuous stirring for 60 minutes is $0.7<[Q^T/M_{3600}]/[Q^T/M_{180}]<1.3$. Here, $[Q^T/M_{3600}]/[Q^T/M_{180}]$ means the ratio between $Q^T/M_{180}$ and $Q^T/M_{3600}$ (the same applies below). If the aforementioned ratio is less than 0.7, then similarly to the foregoing, the charge declines excessively with long-term use, giving rise to image abnormalities such as background smear, scattering of toner, and the like. On the other hand, if the ratio is greater than 1.3, then similarly to the foregoing, the charging up of the toner is not absorbed adequately, and image abnormalities such as decline in the image density occur.

The image forming method according to the present invention is an image forming method which includes the steps of charging a member to be charged by applying a voltage to a charging device; exposing the charged member to form thereon a latent electrostatic image; developing the electrostatic latent image using a toner to form a toner image on the charged member; transferring the toner image formed on the chargeable body to a transfer medium, either directly or via an intermediate transfer body; and fixing the toner image to the transfer medium by heating; wherein the developing step includes an stirring and conveyance step of conveying the developer while stirring and charging same, and in the stirring and conveyance step, the rotational speed $\alpha$ (revolutions per min), the pitch $\beta$ (mm), and the conveyance path length $\gamma$ (mm) of the stirring and conveyance device (excluding the developing device) which stirs and conveys the developer, at the least, satisfy the relationship: $1.0\times10^6 \leqq \alpha\times\beta\times\gamma \leqq 16.0\times10^6$. If $\alpha\times\beta\times\gamma$ is smaller than $1.0\times10^6$, then with long-term use, the charge declines excessively, and image abnormalities, such as background smear, scattering of toner, and the like, occur, whereas if $\alpha\times\beta\times\gamma$ is greater than $16.0\times10^6$, then the charging up of the toner is not absorbed sufficiently and image abnormalities, such as decline in the image density, occur.

Here, the rotational speed $\alpha$ is, for example, the number of revolutions of a screw which stirs and conveys developer inside a developer accommodating unit in a first stage of supplying developer to a developing roller, in a developing device of a commonly known and generally used image forming apparatus, the pitch $\beta$ is the pitch of this screw, and the conveyance path length $\gamma$ is the movement distance until the toner which has been supplied by the toner cartridge arrives at the development roller.

Polyol resins are used as the binder resin employed in the present invention, from the viewpoint of obtaining high image luster, good color reproduction, and a broad fixing temperature range, in a full-color image. For the polyol resins, in view of the environmental stability of charging, the fixing stability, color reproducibility, stability of luster, preventing curling after fixing and the like, it is desirable to employ one in which the epoxy resin is end-capped and have a polyoxyalkylene part in the main chain. For example, this can be obtained by reacting an epoxy resin having a glycidyl group at either end and an alkylene oxide adduct of bivalent phenol having a glycidyl group at either end, with a dihalide, isocyanate, diamine, diol, polyvalent phenol, or dicarboxylic acid. Of these, reaction with bivalent phenol is most desirable from the viewpoint of reaction stability. Furthermore, it is also desirable to combine the use of a polyvalent phenol or a polyvalent carboxylic acid, with the bivalent phenol, within a range in which gelation does not occur.

Preferably, the polyol resin used in the present invention has a molecule chain where the ratio EX/OH between the epoxy groups (EX) and the OH groups (OH) is 0.990 to 1.010. If the ratio EX/OH is less than 0.990, then due to the large presence of OH groups in the molecule chain, absorption of moisture is liable to arise in high-humidity conditions, the charge amount on the toner declines, and image abnormalities such as background smear, scattering of toner, and the like, occur. On the other hand, if the ratio EX/OH is greater than 1.010, then the reaction stability decreases, and the functions of the polyol resin cannot be displayed satisfactorily.

Any commonly known dye or pigment can be used as the coloring material, for example, in the case of the color yellow: Naphthol Yellow S, Hansa Yellow (10G, 5G, G), cadmium yellow, yellow iron oxide, yellow ochre, chrome yellow, Titan Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, or isoindolinone yellow; in the case of the color magenta, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo Red B, Thioindigo Maroon, Oil Red, quinacridone red, Pyrazone Red, Chrome Vermilion, Benzidine Orange, Perynone Orange, or Oil Orange; in the case of the cyan toner, cobalt blue, cerulean blue, Alkali Blue Lake, Peacock Blue Lake, Victoria Blue Lake, metal-free phthalocyanine blue, phthalocyanine blue, Fast Sky Blue, Indanthrene Blue (RS, BC), indigo, ultramarine, Prussian blue, anthraquinone blue, Fast Violet B, Methyl Violet Lake, cobalt violet, manganese violet, dioxazine violet, anthraquinone violet, chrome green, zinc green, chromium oxide, viridian emerald green, Pigment Green B, Naphthol Green B, Green Gold, Acid Green Lake, Malachite Green Lake, phthalocyanine green, anthraquinone green, titanium oxide, zinc white, or lithopone, or mixtures of these; and in the case of black toner, carbon black, nigrosine dyes, or black iron oxide; and furthermore, cyan pigments, and the like, can be used as complementary colors. For each of the colors, the amount used is generally 0.1 to 50 parts by mass with respect to 100 parts by mass of binder resin.

The toner used in the present invention may include a charge control agent, according to requirements. Any commonly known charge control agent may be used, for example, a nigrosine dye, a triphenyl methane dye, a chromium-containing metal complex dye, a molybdic acid chelate pigment, a rhodamine dye, an alkoxyamine, quaternary ammonium salt (including a fluorine-modified quaternary ammonium salt), alkylamide, phosphorous or a compound containing phosphorous, tungsten or a compound containing tungsten, a fluorine activating agent, a metal salt of salicylic acid, a metal salt of a salicylic acid derivative, or the like. The charge controlling agent used is decided on the basis of the toner manufacturing method, such as the type or amount of the binder resin and additives, and the like, and therefore it cannot be determined universally, but a desirable range is 0.1 parts by mass to 10 parts by mass with respect to 100 parts by mass of the binder resin. A more desirable range is 0.5 parts by mass to 3 parts by mass. If the amount is less than 0.1 parts by mass, the negative charge of the toner is insufficient and hence it is not practicable. If the amount exceeds 10 parts by mass, then the charge of the toner becomes too great, leading to decline in the image density due to the toner becoming spent or creating filming due to increase in the electrostatic attraction between the toner and the carrier, developer sleeve, and the like. Moreover, according to requirements, it is also possible to combine the use of a plurality of charge control agents. Furthermore, it is also possible to change the added amount in accordance with the developing sequence of the toners of the respective colors.

The toner used in the present invention may also include wax, according to requirements. The melting point of the wax is 40° C. to 120° C., and more particularly, 50° C. to 110° C. If the melting point of the wax exceeds 120° C., then the fixing properties may be insufficient at low temperature, whereas if the melting point is less than 40° C., then the offset resistance and durability may decline. The melting point of the wax can be determined by differential scanning calorimetry (DSC). In other words, the melting point is taken to be the peak fusion point when a sample of several mg is heated at a uniform rate of temperature rise, for example, (10° C./min). For the wax, it is possible to use, for example, a solid paraffin wax, a micro wax, a rice wax, a fatty acid amine wax, a fatty acid wax, an aliphatic monoketone, a fatty acid metal salt-based wax, a fatty acid ester-based wax, a partially gelated fatty acid ester-based wax, a silicone varnish, a higher alcohol, a Carnauba wax, or the like. Furthermore, it is also possible to use a polyolefin, such as a low-molecular-weight polyethylene, propylene, or the like. A polyolefin having a softening point of 70° C. to 150° C. based on a ball and ring method is particularly desirable, and a polyolefin having a softening point of 120° C. to 150° C. is even more desirable.

Furthermore, examples of the carrier used for the two-component developer are similar to those known in the prior art; namely, iron powder, ferrite, magnetite, glass beads, or the like. Furthermore, the carrier may be coated with resin. Examples of such resin include polycarbon fluoride, polyvinyl chloride, polyvinylidene chloride, phenol resins, polyvinyl acetal, silicone resins. In any case, in general, a suitable mixture ratio between the toner and the carrier is approximately 1.5 parts by mass to 10.0 parts by mass of toner with respect to 100 parts by mass of carrier.

The external additive used in the present invention may be fine inorganic particles of a metal oxide, a metal carbide, a metal nitride, a metal carbonate, or the like. More specifically, it is possible to use, for instance, silica, alumina, titanium oxide, barium titanate, magnesium titanate, calcium titanate, strontium titanate, zinc oxide, tin oxide, quartz sand, clay, mica, wallstonite, diatomaceous earth, chromium oxide, cerium oxide, red iron oxide, antimony trioxide, magnesium oxide, zirconium oxide, barium sulfate, barium carbonate, calcium carbonate, silicon carbide, silicon nitride, or the like. Furthermore, it is also possible to use fine organic particles for the external additive. More specifically, it is possible to employ fine polymer particles such as polystyrenes obtained by soap-free emulsion polymerization, suspension polymerization or dispersion polymerization; methacrylates; acrylate copolymers; silicone; benzoguanamine; polycondensates such as silicone; and thermosetting resins.

Furthermore, by subjecting the external additives used in the present invention to surface treatment in order to raised the hydrophobic properties thereof, then it is possible to prevent deterioration of the fluidity and the charging characteristics, even under high humidity conditions. Desirable surface treatment agents for use in this surface treatment include, for example, coupling agents which may contain an alkyl group, a fluoroalkyl group, or the like such as a silane coupling agent, a titanate coupling agent, an aluminum coupling agent, or the like, silicone oil, a higher fatty acid, a fluorine compound, or the like.

In particular, a silane coupling agent given as one example of a coupling agent is used with the object of improving the degree of hydrophobization and fluidity. More specifically, chlorosilane, alkoxysilane, silazane, a special silylating agent, or the like, may be used as a silane coupling agent, and of these, alkyoxysilane is desirable. The alkoxysilane may be, for example, vinyl trimethoxysilane, propyl trimethoxysilane, i-butyl trimethoxysilane, n-butyl trimethoxysilane, n-hexyl trimethoxysilane, n-octyl trimethoxysilane, n-dodecyl trimethoxysilane, or the like.

For silicone oil, it is possible to use poly dimethyl siloxane, poly methylphenyl siloxane, poly diphenyl siloxane, or the like. Moreover, it is also possible to use a siloxane containing fluorine, or the like, as a silicone oil.

Furthermore, for the fluorine compound, it is desirable to use an organic silicon compound which contains fluorine atoms, such as 3,3,4,4,5,5,6,6,6-nonafluorohexyl trichlorosilane, 3,3,3-trifluoropropyl trimethoxy silane, methyl-3,3,3-trifluoropropyl dichlorosilane, dimethoxy methyl-3,3,3-trifluoropropyl silane, and 3,3,4,4,5,5,6,6,6-nanofluoro hexylmethyl dichlorosilane.

Possible examples of higher fatty acids include stearic acid, oleinic acid, palmitic acid and linoleic acid. Furthermore, for the higher fatty acid, it is also possible to use metal salts of these acids, and more specifically, zinc stearate, aluminum stearate, copper stearate, magnesium stearate, calcium stearate, zinc oleate, manganese oleate, zinc palmitate, zinc linoleate, calcium linoleate, or the like.

In the present invention, preferably, the fine inorganic particles forming the external additive having a low resistance are titanium oxide which has been subjected to hydrophobization processing.

Moreover, preferably, the external additive used in the present invention has an average primary particle size of 0.005 μm to 0.03 μm, and more preferably, 0.01 μm to 0.02 μm. If the average primary particle size is less than 0.005 μm, then when the external additive and toner base particles are subjected to mixing in a mixer, or the like, the external additive is scattered and adheres to the walls of the mixer, or the like, and therefore it is not possible to make the external additive adhere satisfactorily to the surface of the toner base particles. If, on the other hand, the average primary particle size is greater than 0.03 μm, then it is necessary to use a greater dose in order to ensure the same fluidity and leak points as those achieved in the case of a smaller particle size, and problems such as spent carrier, arise.

Preferably, the total added amount of the external additive used in the present invention is 0.5 wt % to 3.5 wt % with respect to the weight of the toner base particles.

Next, a toner manufacturing method will be described.

The toner used in the present invention is manufactured by successively performing: a step of mechanically mixing a toner composition containing a binder resin, colorant and charge control agent and the like; a melting and kneading step; a crushing step; and a classification step. Furthermore, a toner component having a particle size that falls outside a prescribed range (hereinafter referred to as substandard component) that results in the crushing step and/or the classification step can be mechanically re-mixed with the toner composition. Of course, toner can be manufacturing without re-mixing such a substandard component. If the toner is manufactured using the substandard component, the added amount thereof is preferably 5 parts by mass to 40 parts by mass, and more preferably, 10 parts by mass to 35 parts by mass with respect to 100 parts by mass of the toner composition excluding substandard component. If the prescribed external particle size component is kneaded two times, then it becomes relatively brittle and utilizing this fact, it is possible to improve the crushing properties. Therefore, if the amount is less than 5 parts by mass, the beneficial results become weaker. Conversely, if the amount is greater than 40 parts by mass, then problems relating to storage properties and durability arise.

In the toner manufacturing method used in the present invention, the mixing step for mechanically mixing a binder resin, coloring material, charge control agent and substandard component should be carried out under normal conditions using a normal mixing machine equipped with a rotating blade or the like, but it is not limited to this.

When the mixing step described above has been completed, the resulting mixture is loaded into a kneading machine and subjected to melting and kneading. The melting and kneading machine used may be a single-axis or dual-axis continuous kneading machine, or a batch type of kneading machine based on a roll mill. It is important that the melting and kneading should be carried out under suitable conditions which prevent breaking of the molecule chains of the binder resin. More specifically, it is desirable that the melting and kneading process should be carried out in a temperature range of 40° C. to 65° C. If the melting and kneading temperature is lower than 40° C., then there is severe breaking of the molecule chains, whereas if the temperature is greater than 65° C., then dispersion is inhibited.

After the aforementioned melting and kneading step has been completed, the kneaded mixture is then crushed. In this crushing step, preferably, the mixture is first crushed coarsely and then crushed finely. In this, it is desirable to use a method which crushes particles against a collision plate in an air jet, or a method which crushes particles in the narrow gap between a mechanically turning rotor and stator.

When the crushing step has been completed, the crushed material is classified in an air stream, by centrifugal force, or the like, thereby manufacturing toner base particles having a prescribed particle size, for example, a weight-average particle size of 5 μm to 12 μm. In this, it is particularly desirable to have toner base particles having such a small particle size that the weight-average particle size is 5 μm to 9 μm and the amount of toner particles having a diameter of 4 μm or less is 10 number % or less. The substandard component obtained in the crushing step and/or the classification step is returned to the mixing step for use as a recycled component.

Moreover, the fine inorganic particles of hydrophobic silica or hydrophobic titanium oxide, or the like, mentioned above are added to and mixed with the toner base particles obtained by means of the steps described above. A general powder mixing machine is used for mixing the external additive, and it is desirable to adjust the internal temperature of the mixing machine by providing a jacket, or the like. The additive should be added at an intermediate point, or progressively, in order to change the rate of adherence (adhesion strength) of the external additive to the surface of the toner base particles. Of course, it is also possible to vary the speed of rotation, the processing time, the temperature, and the like, of the mixing machine. For example, it is possible to apply a strong load at first and then apply a relatively weak load, or vice versa. Examples of the mixing machine which can be used include V type mixer, rocking mixer, Loedige mixer, Nauta mixer, and Henschel mixer.

(Measurement of Resistance of External Additive)

For the apparatus which measures the dielectric loss of the external additive, it is possible to use a TR-10C type dielectric loss measuring device (manufactured by Ando Electric Co., Ltd.). 5.0 g to 5.1 g of the external additive is weighed out and then subjected to a load of 6 t/cm$^2$ for 1 minute, thereby molding the external additive into a circular disk having a diameter of 40 mm and a thickness of 2.2 mm to 2.5 mm to prepare a measurement sample. The obtained sample is fixed to a jig and measured at room temperature (25° C.). The frequency is set to 1 kHz, and a ratio to $1\times10^{-9}$. The Log (R) is calculated from the conductance (R) obtained as a result of the measurement, and can be taken as the resistance value of the external additive.

In the two types of fine inorganic particles having different resistance values used in the present invention, the difference between the resistance values of these fine inorganic particles is preferably $1.0\times10^3$ to $1.0\times10^6$ (log Ω×cm).

(Particle Size Distribution of External Additive)

For the apparatus which measures the particle size distribution of the external additive, it is possible to use a laser diffraction particle size analyzer LA-920 (manufactured by Horiba Seisakusho). 0.1 ml to 5 ml of surfactant (and more preferably, alkyl benzene sulfonate) is added as a dispersant to 100 ml to 150 ml of an aqueous electrolyte solution. Here, the electrolyte solution is adjusted to an approximately 1 wt % NaCl aqueous solution using primary sodium chloride, and it is possible to use ISOTON-II (manufactured by Coulter Co., Ltd.). 0.1 mg to 0.3 mg of external additive is also added. The electrolyte liquid containing the external additive in suspension is subjected to dispersion processing for approximately 1 minute to 3 minutes for an ultrasonic disperser, the frequency distribution is calculated by the measurement apparatus, and the arithmetic variance Y which indicates the breadth of distribution can be calculated on the basis of the following equation.

$$\text{Arithmetic variance } Y=\Sigma[(X(J)-\text{Mean})^2\times q(J)/100](\mu m^2)$$

J: particle size distribution sequence number q(J): frequency distribution value (%)

X(J): representative value of Jth particle size range (μm)

Mean: arithmetic mean size (μm)

(Rate of Adherence of External Additive)

The rate of adherence of the external additive to the surface of the toner base particles is measured as described below. 5 g of toner having external additive adhering to the toner particles is immersed in 100 ml of a 0.2 wt % aqueous solution of a surfactant ((product name: Drywell) made by Fuji Film Corporation, concentration: 33 wt %), whereupon, using an ultrasonic homogenizer (UH-30 made by Cho-onpa Kogyo Co., Ltd.), an ultrasonic oscillator is immersed in the dispersion liquid, and caused to oscillate ultrasonically at a resonance frequency of 25 kHz for 1 minute, thereby removing the fine inorganic particles from the surfaces of the toner base particles. Thereupon, the dispersion liquid is washed, filtered and dried. 3.0 g to 3.1 g of the dried toner is weighed out and subjected to a load of 6 t/cm$^2$ for 1 minute, thereby forming the toner into a circular disc having a diameter of 40 mm and a thickness of 2.2 mm to 2.5 mm, and the amount of fine inorganic particles remaining on the surfaces of the toner particles is quantified by fluorescent X-ray spectroscopy. This quantitative amount is taken as $M_1$. Toner which has not been subjected to the ultrasonic processing described above is also molded in a similar fashion and the amount of fine inorganic particles present on the surfaces of the toner particles is quantified by fluorescent X-ray spectroscopy, the resulting quantitative amount being taken as $M_0$. The adherence rate of the external additive can then be determined by using the following formula.

$$\text{Adherence rate of external additive: } (M_1/M_0)\times 100\ (\%)$$

(Degree of Hydrophobization of External Additive Measured with Methanol Method)

The degree of hydrophobization of the external additive as measured with methanol method is described below. 0.1 g of the external additive is measured into a 200 ml beaker, 50 ml of demonized water dyed with an edible blue dye no. 1 is added, and stirring is carried out using a magnetic stirrer. Using a burette methanol is then added dropwise at a rate of approximately 2 ml every 10 seconds, and the end point is taken as the state where the external additive floating on the liquid surface becomes completely wetted. The degree of hydrophobization can then be determined from the following equation.

Degree of hydrophobization of external additive=Added amount/(Added amount+50)×100 (%)

(Average Circularity of Toner Base Particles)

The average circularity of the toner base particles is the average circularity as measured by an image diffraction method, and preferably, it is the value as measured using an FPIA-2100 flow particle image analyzer manufactured by Sysmex Co., Ltd.

The FPIA-2100 analyzer first calculates the circularity of respective particles, assigning each particle to one of 61 separate fraction bands between a circularity of 0.4 and 1.0, and then uses a fractionation method to calculate the average circularity on the basis of the central values of the fraction points and their frequency. The error between the average circularity value calculated by this method and the average circularity calculated by summing the circularity values of each particle (summation method) is extremely small, and is of a level which can be effectively ignored. In calculating the average circularity of the toner base particles in the present invention, a summation method may be used, but it is possible to use the fractionation method for data handling reasons, such as reducing the calculation time and simplifying the calculation operations involved. Moreover, compared to the FPIA1000 apparatus which has been used conventionally in order to calculate the shape of toner, the FPIA-2100 apparatus which can be used to measure the average circularity of the toner base particles of the present invention has thinner sheath flow layers (down from 7 μm to 4 μm), enhanced magnification of the processed particle image, and improved resolution of the input images (enhanced from 256×256 to 512×512), and therefore the accuracy of the toner shape measurement is raised and the fine particles can be investigated more reliably. Consequently, in the calculation of the average circularity of the toner base particles, it is desirable to use a FPIA-2100 analyzer which provides more accurate data on the shape and particle size distribution. The aforementioned analyzer is used under operating conditions of 23° C. and 60% RH, and by analyzing the images projected by particles having an equivalent-circle diameter in the range of 0.60 μm to 400 μm, the length L of the circle perimeter is measured. The circularity of a particle is determined on the basis of the circle circumference thus measured, by means of the equation given below. Moreover, the sum of the circularities of the particles, and the number of particles, are found in respect of the particles which have an equivalent-circle diameter in the range of 3 μm to 400 μm. The average circularity is found by dividing the sum of the circularities by the number of particles.

$$\text{Circularity}=L_0/L$$

(where L0 is the circumferential length of the circle having a projected surface area equal to that of the particle image, and L is the circumferential length of the particle image when the image is processed at a resolution of 512×512 (pixels of 0.3 μm×0.3 μm in size)).

The measurement procedure is described in more detail below. A surfactant (or alkyl benzene sulfonate) (0.1 ml to 0.5 ml) is added as a dispersant to water (200 ml to 300 ml) in a container from which impurities have previously been removed, and furthermore approximately 0.1 g to 0.5 g of a measurement sample is added. The suspension containing the dispersed sample is subjected to dispersion processing for 2 minutes by an ultrasonic wave generator, and the concentration of the dispersion liquid is set to 2,000 to 10,000 particles per μl. The apparatus described below, for example, was used as the ultrasonic wave generator, under the following dispersion conditions.

UH-150 (made by SMT Co., Ltd.)

Output level: 5

Constant Mode

The circularity distribution of the particles obtained by the method described above is then measured. An overview of the measurement procedure is described below.

The sample dispersion liquid is passed through a flow channel (which broadens in the direction of flow) consisting of a flat and parallel flow cell (approximately 200 μm thick). A strobe and CCD camera are installed at positions on mutually opposite sides of the flow cell so as to form a light path which passes orthogonally through the thickness of the flow cell. The strobe light is irradiated at intervals of $1/30^{th}$ of a second while the sample dispersion liquid is passed through the flow cell, and images of the particle dispersion in the sample dispersion liquid are obtained. Consequently, the respective particles are captured in the form of two-dimensional images having a uniform range parallel to the flow cell. The diameter of the circle having the same surface area as each particle is calculated as the equivalent-circle diameter, from the surface area of the two-dimensional images of the respective particles. The circularities of the respective particles are calculated by means of the circularity calculation formula described above, on the basis of the projected surface area and the perimeter length of the projected image of the two-dimensional image of each of the respective particles. It is possible to determine the average circularity from the calculated circularity values, as described previously.

(Charge Amount $Q^B/M$ of Toner Base Particles and Charge Amount $Q^T/M$ of Toner Particles)

The charge amounts of the toner base particles and the toner particles are measured as described below. 3 g of developer prepared by combining toner base particles or toner particles and carrier is introduced into a round cylindrical stainless steel container having a diameter of 2.5 cm and a height of 3.0 cm, and is stirred for 3 minutes in a ball mill at a speed of 250 rpm. The toner concentration (TC) in the developer is set to be 3 wt % to 7 wt %. The charge amount on the toner in the developer is measured on a lateral flow measurement instrument. The charge amount thus obtained is defined as $Q^B/M_{180}$ or $Q^T/M_{180}$. Similarly, the charge amount obtained after stirring for 60 minutes defined set as $Q^B/M_{3600}$ or $QT/M_{3600}$.

EXAMPLES

The present invention is described more specifically with reference to Examples, but the scope of the present invention is not limited to these Examples. In the following description, the term "parts" used to indicate the ratios in a mixture, or the like, refers to parts by mass, in all cases.

Synthesis Example of Polyol

Synthesis Example 1

1,000 g of a low-molecular-weight bisphenol A type epoxy resin (number-average molecular weight: approximately 1,000), 50 g of terephthalic acid, 10 g of benzoic acid, and 300 g of xylene were introduced into a separable flask fitted with an stirring apparatus, a thermometer, an $N_2$ inlet and a cooling tube. The mixture was heated to 70° C. to 100° C. in a nitrogen atmosphere, 0.183 g of lithium chloride was added, and the temperature was raised further to 160° C., the xylene was distilled off at reduced pressure, and polymerization was carried out for 6 hours to 9 hours at a reaction temperature of 180° C., thereby obtaining approximately 1 kg of polyol resin having a softening point of 108° C. and a Tg point of 61° C. (hereinafter, called "Resin 1"). The ratio EX/OH between the epoxy groups (EX) and the OH groups (OH) was 0.995.

Synthesis Example 2

500 g of a low-molecular-weight bisphenol A type epoxy resin (number-average molecular weight: approximately 1,000), 404 g of high-molecular-weight bisphenol A type epoxy resin (number-average molecular weight: approximately 50,000), 103 g of bisphenol A, 59 g of p-cumylphenol, and 300 g of xylene were introduced into a separable flask, using the apparatus described in synthesis example 1. The mixture was heated to 70° C. to 100° C. in a nitrogen atmosphere, 0.183 g of lithium chloride was added, and the temperature was raised further to 160° C., xylene was distilled off at reduced pressure, and polymerization was carried out for 6 hours to 9 hours at a reaction temperature of 180° C., thereby obtaining 1000 g of polyol resin having a softening point of 109° C. and a Tg point of 58° C. (hereinafter, called "Resin 2"). The ratio EX/OH between the epoxy groups (EX) and the OH groups (OH) was 1.000.

Synthesis Example 3

302 g of a low-molecular-weight bisphenol A type epoxy resin (number-average molecular weight: approximately 360), 100 g of high-molecular-weight bisphenol A type epoxy resin (number-average molecular weight: approximately 3000), 336.0 g of a digylcidyl compound of a bisphenol A type ethylene oxide adduct (where n+m: approximately 5.9 in the general formula (3) given above), 210 g of bisphenol A, 100 g of p-cumylphenol, and 300 g of xylene were introduced into a separable flask, using the apparatus described in synthesis example 1. The mixture was heated to 70° C. to 100° C. in a nitrogen atmosphere, 0.183 g of lithium chloride was added, and the temperature was raised further to 160° C., the xylene was distilled off at reduced pressure, and polymerization was carried out for 6 hours to 9 hours at a reaction temperature of 180° C., thereby obtaining approximately 1 kg of polyol resin having a softening point of 109° C. and a Tg point of 58° C. (hereinafter, called "Resin 3"). The ratio EX/OH between the epoxy groups (EX) and the OH groups (OH) was 1.005.

Synthesis Example 4

390 g of a low-molecular-weight bisphenol A type epoxy resin (number-average molecular weight: approximately 680), 403 g of high-molecular-weight bisphenol A type epoxy resin (number-average molecular weight: approximately 6500), 199 g of a bivalent acid of a condensate of bisphenol A type propylene oxide adduct and anhydrous phthalic acid, 50 g of bisphenol A, 51 g of p-cumylphenol, and 300 g of xylene were introduced into a separable flask, using the apparatus described in Synthesis Example 1. The mixture was heated to 70° C. to 100° C. in a nitrogen atmosphere, 0.183 g of lithium chloride was added, and the temperature was raised further to 160° C., the xylene was distilled off at reduced pressure, and polymerization was carried out for 6 to 9 hours at a reaction temperature of 180° C., thereby obtaining approximately 1 kg of polyol resin having a softening point of 112° C. and a Tg point of 59° C. (hereinafter, called "Resin 4"). The ratio EX/OH between the epoxy groups (EX) and the OH groups (OH) was 1.015.

Examples of Manufacture of Toner Base Particles

Manufacturing Example 1

Toner Materials

Binder resin: Resin 1 . . . 100 parts

Colorant: cyan pigment (copper phthalocyanine) . . . 5 parts

Charge control agent: Bontron E-84 (manufactured by Orient Chemical Industries, Co., Ltd.) . . . 2 parts The toner materials described above were mixed in a Henschel mixer (made by Mitsui Mitsuike Co., Ltd.), and then kneaded for 30 minutes by two rollers set to a surface temperature of 60° C. Thereupon, after cold rolling and coarse crushing, toner base particles were obtained by processing in a jet mill type of crushing machine (I-2 type mill, manufactured by Nihon Pneumatic Industries, Co., Ltd.) and carrying out airborne sorting (DS Separator: manufactured by Nihon Pneumatic Kogyo, Co., Ltd.) using a revolving air flow. The frictional charge on the carrier (hereinafter, called "Base 1"), $[Q^B/M_{3600}]/[Q^B/M_{180}]$ was 2.3, and the average circularity was 0.925. (0042)

Manufacturing Examples 2 to 4

Toner base particles were obtained by using the same method and the same quantities as in Manufacturing Example 1, with the exception that the binder resin in manufacturing example 1 was changed respectively to the "Resin 2" to "Resin 4" of the synthesis examples 2 to 4. The frictional charge on the carriers (hereinafter, called "base 2 to base 4"), $[Q^B/M_{3600}]/[Q^B/M_{180}]$, was 1.9 in the case of "Base 2", 1.6 in the case of "Base 3", and 1.2 in the case of "Base 4". The average circularity was 0.932 in the case of "Base 2", 0.928 in the case of "Base 3" and 0.936 in the case of "Base 4".

Manufacturing Example 5

Toner base particles were obtained (hereinafter, called "Base 5") by using the same method and the same quantities as in Manufacturing Example 1, with the exception that the binder resin in Manufacturing Example 1 was changed to a polyester resin. The polyester resin was obtained by condensation polymerization of a bisphenol A ethylene oxide adduct, a bisphenol A propylene oxide adduct, terephthalic acid, and fumaric acid, at a mol ratio of 60:40:25:75, and had a softening point of 107° C. and a Tg point of 59° C. The charge from friction with the carrier, $[Q^B/M_{3600}]/[Q^B/M_{180}]$, was 2.1 and the average circularity was 0.941.

Example 1

1.2 parts of hydrophobic silica (HDK2000H: manufactured by Clariant Japan Co., Ltd.; degree of hydrophobization (methanol method): 70%), and 0.9 parts of titanium oxide (JMT-150IB, manufactured by Tayca Corporation; particle size distribution Y: 0.005; degree of hydrophobization (as measured with methanol method): 65%) were added as external additives to 100 parts of "Base 1", and mixed in a Henschel mixer, thereby yielding toner particles. The charge from friction with the carrier (hereinafter, called "Toner 1"), $[Q^T/M_{3600}]/[Q^T/M_{180}]$, was 1.0, and the adherence rate of the titanium oxide was 80%. The toner thus obtained was subjected to the following evaluations.

Examples 2 to 6

Comparative Examples 1 to 7

Toners 2 to 13 were prepared in a similar manner to Example 1, with the exception that the toner base particles and the additives were used in the quantities shown in Table 1. However, in Example 6, the circumferential speed of the mixing blades during mixing in the Henschel mixer was set to 1.2 times the circumferential speed in Example 1, and in Comparative Example 2, it was set to 0.8 times the circumferential speed in Example 1.

The following additives were used. The toners obtained by the method described above were subjected to the evaluations described below.

Hydrophobic silica (HDK2000H: manufactured by Clariant Japan; degree of hydrophobization (as measured with methanol method): 70%; resistance value $1.0\times10^{12}$)

Titanium oxide (JMT-150IB: manufactured by Tayca Corporation; particle size distribution Y: 0.005; degree of hydrophobization (methanol method): 65%; resistance value $1.0\times10^{8}$)

Titanium oxide (MT-150AI: manufactured by Tayca Corporation; particle size distribution Y: 0.010; degree of hydrophobization (as measured with methanol method): 65%; resistance value $1.2\times10^{8}$)

has an average particle size of 50 μm and is coated with silicone resin to an average thickness of 0.3 μm, in the proportions of 5 parts toner to 100 parts carrier, and mixed uniformly and charged in a tumbler mixer of a type which performs stirring by means of a rolling motion of a container, thereby fabricating respective developers. A copying test was carried out using the developer in a modified "Imagio Neo C600" digital full-color copying machine manufactured by Ricoh, and the items indicated below were evaluated. The copying test was carried out for 100,000 sheets in full color mode. The image quality of the image thus obtained was evaluated in terms of background smear and image density. The operating conditions specified in the present invention for the modified Ricoh "Imagio Neo C600" digital full-color copying machine were: rotational speed α (revolutions per min): 600; pitch β (mm): 10; conveyance path length γ (mm): 700; $\alpha\times\beta\times\gamma$: $4.2\times10^{6}$.

Each of the evaluation items listed below was evaluated after continuous copying of an image chart having a 3% image surface area, until 100,000 sheets had been copied.

(1) Background Smear

A blank white image was halted during developing, the developer on the photoconductor after developing was transferred to a tape, and the difference with respect to the image density of an unused tape was measured with an X-Rite 938 spectrodensitometer.

(2) Image Density

The image ID of right-hand, left-hand and central patches of an image chart having a 3% image surface area was measured with an X-Rite 938 spectrodensitometer, and the average value was determined.

Evaluation of Image Quality (at High-temperature, High-humidity Environment, Low-temperature, Low-humidity Environment)

TABLE 1

| | Toner | Base | Silica | Quantity (parts) | Titanium | Quantity (parts) | $[Q^T/M_{3600}]/[Q^T/M_{180}]$ | Adherence rate (%) |
|---|---|---|---|---|---|---|---|---|
| Example 1 | Toner 1 | Base 1 | HDK2000H | 1.2 | JMT-150IB | 0.9 | 1.0 | 80 |
| Example 2 | Toner 2 | Base 1 | HDK2000H | 0.8 | JMT-150IB | 0.1 | 1.2 | 90 |
| Example 3 | Toner 3 | Base 1 | HDK2000H | 0.6 | JMT-150IB | 2.0 | 0.8 | 75 |
| Example 4 | Toner 4 | Base 1 | HDK2000H | 0.7 | MT-150AI | 2.0 | 1.1 | 75 |
| Example 5 | Toner 5 | Base 2 | HDK2000H | 1.0 | JMT-150IB | 0.7 | 1.0 | 85 |
| Example 6 | Toner 6 | Base 3 | HDK2000H | 1.0 | JMT-150IB | 0.7 | 1.1 | 90 |
| Comparative Example 1 | Toner 7 | Base 4 | HDK2000H | 1.5 | JMT-150IB | 0.5 | 1.0 | 85 |
| Comparative Example 2 | Toner 8 | Base 4 | HDK2000H | 1.5 | JMT-150IB | 0.5 | 0.7 | 50 |
| Comparative Example 3 | Toner 9 | Base 5 | HDK2000H | 1.1 | JMT-150IB | 0.6 | 1.4 | 90 |
| Comparative Example 4 | Toner 10 | Base 1 | HDK2000H | 0.5 | JMT-150IB | 0.05 | 1.2 | 95 |
| Comparative Example 5 | Toner 11 | Base 1 | HDK2000H | 1.7 | JMT-150IB | 2.1 | 1.1 | 65 |
| Comparative Example 6 | Toner 12 | Base 2 | HDK2000H | 1.3 | MT-150AI | 1.8 | 1.5 | 85 |
| Comparative Example 7 | Toner 13 | Base 3 | HDK2000H | 2.1 | MT-150AI | 2.1 | 1.2 | 70 |

Image Quality Evaluation (at Room Temperature Environment)

The toners obtained in Examples and Comparative Examples were respectively combined with ferrite carrier that Similar evaluation to that described above for room temperature environment was carried out, with the exception that the evaluation conditions were set to high-temperature and high-humidity conditions (temperature 30° C./relative humidity 90%), and low-temperature and low-humidity conditions (temperature 10° C./relative humidity 15%). Image evaluation was carried out after leaving the evaluation machine previously for 24 hours in the environment described above.

Table 2 shows the results of the evaluation described above.

TABLE 2

| | Room temperature environment | | Low-temperature, low-humidity environment | | High-temperature, high-humidity environment | |
|---|---|---|---|---|---|---|
| | Background smear | Image density | Background smear | Image density | Background smear | Image density |
| Example 1 | 0.007 | 1.52 | 0.008 | 1.49 | 0.011 | 1.55 |
| Example 2 | 0.006 | 1.50 | 0.007 | 1.40 | 0.009 | 1.49 |
| Example 3 | 0.007 | 1.53 | 0.007 | 1.48 | 0.013 | 1.45 |
| Example 4 | 0.008 | 1.49 | 0.009 | 1.49 | 0.011 | 1.53 |
| Example 5 | 0.006 | 1.55 | 0.007 | 1.50 | 0.007 | 1.56 |
| Example 6 | 0.007 | 1.45 | 0.008 | 1.43 | 0.008 | 1.49 |
| Comparative Example 1 | 0.009 | 1.44 | 0.011 | 1.38 | 0.041 | 1.63 |
| Comparative Example 2 | 0.010 | 1.47 | 0.014 | 1.25 | 0.035 | 1.59 |
| Comparative Example 3 | 0.008 | 1.41 | 0.009 | 1.12 | 0.013 | 1.56 |
| Comparative Example 4 | 0.016 | 1.52 | 0.044 | 1.18 | 0.020 | 1.61 |
| Comparative Example 5 | 0.007 | 1.49 | 0.005 | 1.20 | 0.011 | 1.62 |
| Comparative Example 6 | 0.009 | 1.50 | 0.014 | 1.28 | 0.039 | 1.65 |
| Comparative Example 7 | 0.010 | 1.43 | 0.012 | 1.10 | 0.027 | 1.60 |

In the case of Examples of the present invention, excellent image quality was obtained in all cases, in comparison with Comparative Examples.

The present invention provides an image forming method and a toner for developing latent electrostatic images, which simultaneously resolve the issues of charging up during long-term continuous output, and charging down in a high-temperature and high-humidity environment, and is therefore valuable for an ultra-high-speed image forming apparatus.

What is claimed is:

1. An image forming method comprising: charging; exposing; developing; transferring; and fixing, wherein a developer used in the developing is a two-component developer that comprises a toner and a carrier, the toner containing as a binder resin a polyol resin having a plurality of OH groups in a molecule chain having an EX/OH ratio between epoxy groups (EX) and OH groups (OH) of 0.990 to 1.010, the developing step comprises stirring and conveying for conveying at least the developer while stirring and charging the developer, in the stirring and conveying step a rotational speed a (revolutions per minute), a pitch β (mm) and a conveyance path length γ (mm) of an stirring and conveying unit, excluding a developing unit, satisfies the relationship $1.0\times10^6 \leqq \alpha\times\beta\times\gamma \leqq 16.0\times10^6$, the toner is composed of toner base particles and an external additive, the toner base particles having an electrostatic property by stirring with the carrier is such that a ratio between charge amount after continuous stirring for 3 minutes, $Q^B/M_{180}$ (−μC/g), and charge amount after continuous stirring for 60 minutes, $Q^B/M_{3600}$ (−μC/g) satisfy the following Formula (I):

$$1.5<[Q^B/M_{3600}]/[Q^B/M_{180}]<2.5 \quad \text{Formula I}$$

the toner having an electrostatic property by stirring with the carrier is such that a ratio between charge amount after continuous stirring for 3 minutes, $Q^T/M_{180}$ (−μC/g), and charge amount after continuous stirring for 60 minutes, $Q^T/M_{3600}$ (−μC/g) satisfy the following Formula (II):

$$0.7<[Q^T/M_{3600}]/[Q^T/M_{180}]<1.3 \quad \text{Formula II}$$

and the external additive comprises two types of fine inorganic particles having different resistance values, wherein a particle size distribution Y and added amount X, in terms of parts by mass with respect to 100 parts by mass of the toner base particles, of the fine inorganic particles having a smaller resistance value than the other fine inorganic particles satisfy the following Formula (III):

$$0.1 \leqq x \leqq 2.0$$

$$Y \leqq 2.6\times10^{-3}X+0.0048 \quad \text{(Formula III).}$$

2. The image forming method according to claim 1, wherein an adherence rate, expressed by the following Formula IV, of the fine inorganic particles of the external additive having a smaller resistance value is 65% to 95%:

$$(M_1/M_0)\times100\ (\%) \quad \text{(Formula IV)}$$

where $M_1$ is the weight of fine inorganic particles adhering to surfaces of the toner base particles after the toner including the external additive has been dispersed in an aqueous solution containing a surfactant and subjected to ultrasonic treatment for 1 minute at a resonance frequency 25 kHz; and $M_0$ is the weight of fine inorganic particles adhering to surfaces of the toner base particles before carrying out the ultrasonic treatment.

3. The image forming method according to claim 1, wherein the toner base particles have an average circularity of 0.910 to 0.970.

4. The image forming method according to claim 1, wherein the fine inorganic particles that adhere to surfaces of the toner base particles have a degree of hydrophobization of 55% to 95% as measured with methanol method.

5. The image forming apparatus according to claim 1, wherein the fine inorganic particles of the external additive having a smaller resistance value are made of titanium oxide which has been subjected to hydrophobization treatment.

6. A toner for developing latent electrostatic images that is used in a two-component developer that comprises a toner and a carrier, the toner containing as a binder resin a polyol resin having a plurality of OH groups in a molecule chain having an EX/OH ratio between epoxy groups (EX) and OH groups (OH) of 0.990 to 1.010, wherein the toner is composed of toner base particles and an external additive, the toner base particles having an electrostatic property by stirring with the carrier is such that a ratio between charge amount after continuous stirring for 3 minutes, $Q^B/M_{180}$ (−μC/g), and charge amount after continuous stirring for 60 minutes, $Q^B/M_{3600}$ (−μC/g) satisfy the following Formula (I):

$$1.5<[Q^B/M_{3600}]/[Q^B/M_{180}]<2.5 \quad \text{Formula I}$$

the toner having an electrostatic property by stirring with the carrier is such that a ratio between charge amount after continuous stirring for 3 minutes, $Q^T/M_{180}$ (−μC/g), and charge amount after continuous stirring for 60 minutes, $Q^T/M_{3600}$ (−μC/g) satisfy the following Formula (II):

$$0.7<[Q^T/M_{3600}]/[Q^T/M_{180}]<1.3 \quad \text{Formula II}$$

and the external additive comprises two types of fine inorganic particles having different resistance values, wherein a particle size distribution Y and added amount X, in terms of parts by mass with respect to 100 parts by mass of the toner base particles, of the fine inorganic particles having a smaller resistance value than the other fine inorganic particles satisfy the following Formula (III):

$$0.1 \leqq x \leqq 2.0$$

$$Y \leqq 2.6\times10^{-3}X+0.0048 \quad \text{(Formula III).}$$

7. The toner for developing latent electrostatic images according to claim 6, wherein an adherence rate, expressed by the following Formula IV, of the fine inorganic particles of the external additive having a smaller resistance value is 65% to 95%:

$$(M_1/M_0)\times100\ (\%) \quad \text{(Formula IV)}$$

where $M_1$ is the weight of fine inorganic particles adhering to surfaces of the toner base particles after the toner including the external additive has been dispersed in an aqueous solution containing a surfactant and subjected to ultrasonic treatment for 1 minute at a resonance frequency 25 kHz; and $M_0$ is the weight of fine inorganic particles adhering to surfaces of the toner base particles before carrying out the ultrasonic treatment.

8. The toner for developing latent electrostatic images according to claim 6, wherein the toner base particles have an average circularity of 0.910 to 0.970.

9. The toner for developing latent electrostatic images according to claim 6, wherein the fine inorganic particles that adhere to surfaces of the toner base particles have a degree of hydrophobization of 55% to 95% as measured with methanol method.

10. The toner for developing latent electrostatic images according to claim 6, wherein the fine inorganic particles of the external additive having a smaller resistance value are made of titanium oxide which has been subjected to hydrophobization treatment.

* * * * *